United States Patent [19]

Konieczynski

[11] Patent Number: 4,917,296

[45] Date of Patent: Apr. 17, 1990

[54] SPRAYING APPARATUS WITH FLOW ALARM

[75] Inventor: Ronald D. Konieczynski, North Royalton, Ohio

[73] Assignee: Nordson Corporation, Westlake, Ohio

[21] Appl. No.: 328,164

[22] Filed: Mar. 24, 1989

[51] Int. Cl.[4] ..... G08B 21/00; B05B 17/00

[52] U.S. Cl. ..... 239/1; 239/71; 239/72; 239/124

[58] Field of Search ..... 239/1, 71, 72, 124; 222/39; 118/692; 340/608, 611, 626

[56] References Cited

U.S. PATENT DOCUMENTS

| | | | |
|---|---|---|---|
| 2,599,680 | 6/1952 | Weeks | 239/536 |
| 3,482,781 | 12/1969 | Sharpe | 239/71 |
| 4,030,857 | 6/1977 | Smith, Jr. | 417/46 |
| 4,072,934 | 2/1978 | Hiller et al. | 340/608 |
| 4,185,224 | 1/1980 | Thompson | 222/39 |
| 4,193,356 | 3/1980 | Vehe et al. | 340/608 |
| 4,197,995 | 4/1980 | Campbell et al. | 239/74 |
| 4,260,107 | 4/1981 | Jackson | 239/74 |
| 4,313,111 | 1/1982 | Anderson | 340/608 |
| 4,328,824 | 5/1982 | Kiernan et al. | 137/99 |
| 4,430,886 | 2/1984 | Rood | 239/71 |
| 4,562,088 | 12/1985 | Navarro | 118/692 |
| 4,613,528 | 9/1986 | Mueller | 427/421 |
| 4,653,532 | 3/1987 | Powers | 239/124 |
| 4,668,948 | 5/1987 | Merkel | 239/71 |
| 4,723,726 | 2/1988 | Ooishi et al. | 239/703 |
| 4,822,647 | 4/1989 | Nozaki et al. | 118/692 |

FOREIGN PATENT DOCUMENTS

| | | | |
|---|---|---|---|
| 2924264 | 12/1980 | Fed. Rep. of Germany | 118/692 |
| 0917744 | 4/1982 | U.S.S.R. | 239/71 |

*Primary Examiner*—Andres Kashnikow
*Assistant Examiner*—Karen B. Merritt
*Attorney, Agent, or Firm*—Wood, Herron & Evans

[57] ABSTRACT

An apparatus for applying viscous coating material to a surface through spraying devices such as spray guns in which an alarm is activated in the event one or more of the spray guns becomes clogged or otherwise malfunctions. The apparatus includes separate pumps for each of any number of fixtures which supply coating material such as molten wax to spray guns carried by the fixtures. Each fixture includes a valve, and a pressure switch which is operative to sense the fluid pressure within the fixture and activate an alarm at a predetermined level. A controller simultaneously opens at least one spray gun and closes the valve of each fixture to discharge coating material onto a surface. In the event a spray gun becomes clogged or otherwise malfunctions, the fluid pressure within the fixture increases and such increase is sensed by the pressure switch which activates the alarm when the pressure exceeds a predetermined level.

9 Claims, 1 Drawing Sheet

SPRAYING APPARATUS WITH FLOW ALARM

FIELD OF THE INVENTION

This invention relates to devices for spraying viscous coating materials such as wax, and, more particularly, to a device for spraying coating materials which includes an alarm to notify the operator when the spray device has become completely or partially blocked and is no longer discharging coating material at the desired flow rate.

BACKGROUND OF THE INVENTION

A number of applications involve the spraying of coating material onto a surface which is hidden from view. For example, it is common practice among vehicle manufacturers to apply wax or other protective coatings to the inner cavities of vehicle body components such as doors, rear decks and hatchback lids, hoods, fender panels and under bodies. The hem flange areas of such components, and other areas where water and corrosive materials might collect, are often hidden from view and a spray device such as a spray gun must be manipulated in a manner to obtain complete coverage of the area to be coated.

In order to ensure application of a protective coating to the desired locations on such vehicle body components, and with the desired uniformity, spray coating systems have been proposed such as disclosed in U.S. Pat. No. 4,613,528 to Mueller, which is assigned to the same assignee as this invention. The system disclosed in the U.S. Pat. No. 4,613,528 is a mechanical system in which one or more spray guns are placed in the proper position with respect to a vehicle body component to be coated and then automatically manipulated to obtain complete and uniform coverage of the vehicle body component.

One problem with mechanical systems of the type described above, or manual systems for coating vehicle body components, is that no means are provided to indicate to the operator whether or not the spray guns used to apply the coating material are functioning properly. In the course of a spraying operation wherein the spray guns of such systems are completely hidden from view, the operator has no way of determining whether or not the spray guns are discharging coating material at the desired flow rate. Clogging of such spray guns can be a recurring problem when applying wax and similar viscous coating materials which must be maintained at certain temperatures in order to flow freely through the spray guns. Such temperatures might not be maintained throughout a production run, particularly when the spray guns are operated intermittently and/or where the system does not provide for recirculation of the coating material from the spray gun back to the source of coating material when the spray guns are not being operated.

SUMMARY OF THE INVENTION

It is therefore an objective of this invention to provide a spray coating system particularly intended for use in coating surfaces hidden from view, such as portions of vehicle body components, which provides an indication to the operator when one or more of the spray devices associated with the system is partially or completely clogged and not discharging coating material at the desired flow rate.

This objective is accomplished in a spraying system comprising a primary pump which transmits coating material to a flow divider or manifold having a number of pumps connected to a common drive. Each of the pumps discharges a uniform, metered quantity of coating material through a supply line to a fixture having spray guns insertable within a vehicle body component or the like. Each fixture is provided with a sensor located in the supply line which is effective to sense an increase in fluid pressure within the supply line resulting from partial or complete clogging of one or more of the spray guns. At a predetermined pressure level, the sensor activates a visual or audible alarm to notify the operator of the clogging problem so that corrective measures can be undertaken.

In the presently preferred embodiment, the system is designed to include essentially any number of fixtures so that several vehicle body components or other surfaces can be coated simultaneously. Each fixture receives coating material from a pump located in the manifold, and these pumps are preferably driven by a common shaft or belt. The supply lines extending between the pumps in the manifold and each fixture transmit a metered quantity of coating material thereto which is either discharged onto a surface to be coated or recirculated through a return line connected between the fixture and the primary pump or source of coating material. Each fixture includes one or more spray guns connected to the supply line and a valve located in the return line downstream from the spray guns. The pressure sensor associated with each fixture, preferably a pressure switch, is connected to the return line at a location between the spray guns and the valve.

A programmable controller is connected to each of the spray guns, and to the valve, associated with each fixture. The controller is operative to open and close each of the spray guns independently of one another, and to open and close the valve associated with each fixture.

The system of this invention operates as follows. With the spray guns of each fixture in position relative to a vehicle body component or other surface to be coated, the pumps in the manifold each discharge a metered quantity of coating material through a supply line to one of the fixtures. The controller is operative to open one of the spray guns in each fixture and simultaneously close the valve associated with such fixture. The coating material thus flows through the spray gun which has been opened onto the surface to be coated. Preferably, the spray guns of each fixture are operated in succession so that only one spray gun discharges coating material at any given time. When the spraying operation is completed, the controller is operative to close the spray gun which was last to open and simultaneously open the valve. This permits recirculation of the coating material through the return line back to the source of coating material or to the primary pump.

In the event that any of the spray guns in a fixture becomes partially or completely clogged during a spraying operation, or otherwise malfunctions and fails to discharge the desired quantity of coating material, the alarm is activated in the following manner. If the spray gun fails to discharge a predetermined quantity of coating material, a back pressure is created in the return line between the spray guns and the valve associated with the fixture. When this back pressure reaches a predetermined level, the pressure switch is effective to activate an alarm, e.g., a visual or audible alarm, which alerts the operator to the problem so that corrective measures can be undertaken.

Preferably, a pressure relief valve is provided in the manifold downstream from each gear pump as a safety precaution to protect the system in the event of a malfunction of the pressure switch or alarm. The pressure relief valve is operative to permit recirculation of coating material from the outlet of the metering gear pumps back to their inlets instead of through the supply lines. The pressure relief valves open at a pressure higher than that necessary to trip the pressure switches in the fixtures, but before the system could be damaged from excess pressure therein.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
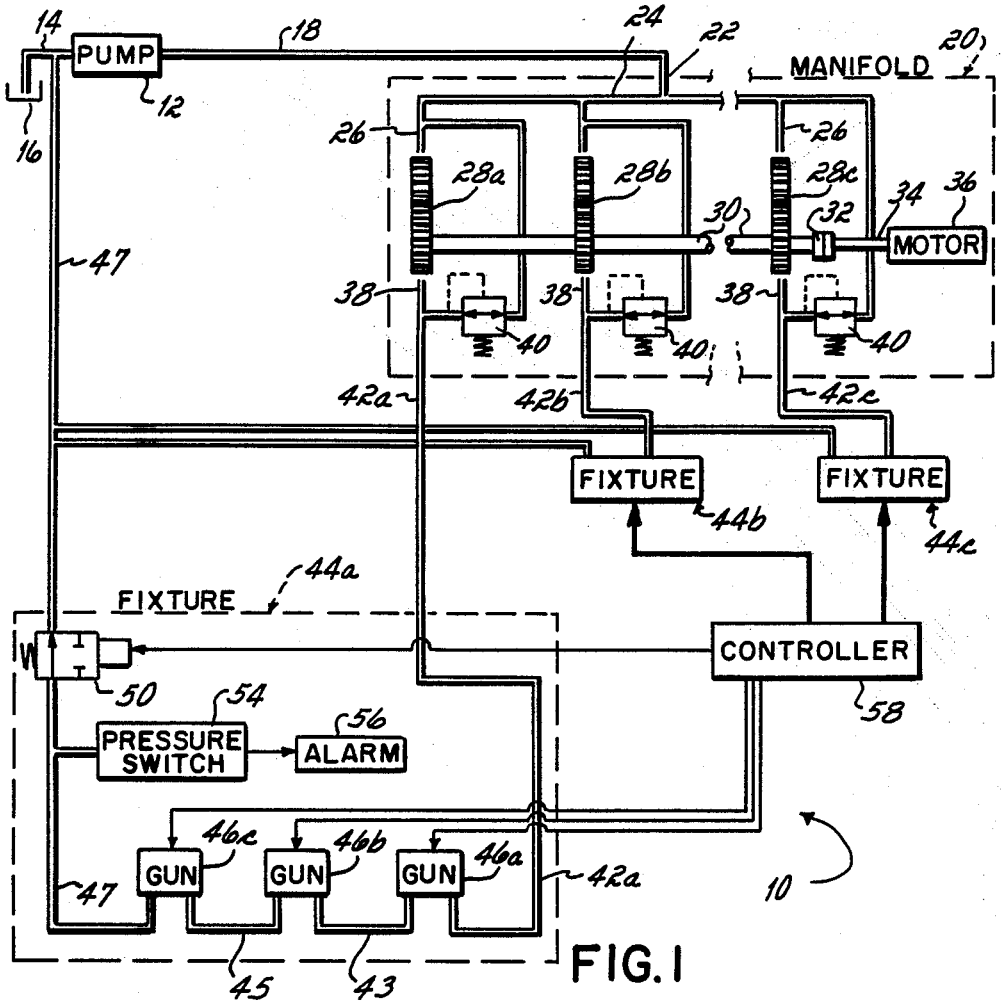
FIG. 1 is a schematic view of the spraying system herein employing metering gear pumps for supplying coating material to the spraying fixture.

Referring now to FIG. 1, the spraying system 10 comprises a primary pump 12 connected by a line 14 to a reservoir 16 or other source of viscous coating material such as molten wax. The primary pump 12 is connected through a line 18 to a flow divider or manifold 20 having an inlet 22. The inlet 22 is connected to a distribution passageway 24 having a number of branch lines 26.

In the embodiment illustrated in FIG. 1, three branch lines 26 are connected to distribution passageway 24, each of which supplies coating material to one of three metering gear pumps 28*a, b* and *c*. While three gear pumps 28*a, b* and *c* are shown in FIG. 1, a broken line is provided between pumps 28*b* and 28*c* in the drawing to illustrate that the manifold 20 could be provided with essentially any number of gear pumps 28 depending upon the requirements of a particular application.

The gear pumps 28*a–c* are driven by a common shaft 30 which is drivingly connected by a coupler 32 to the output shaft 34 of a motor 36. The motor 36 is operative to drive the gear pumps 28 at the same speed so that coating material delivered to the gear pumps through branch lines 26 is discharged in the same, metered quantity through the outlet 38 of each gear pump 28*a–c*. A relief valve 40 is connected to the outlet 38 of each gear pump 28*a–c*. These relief valves 40 are operative to recirculate coating material to the branch lines 26 on the input side of the gear pumps 28*a–c* for purposes to become apparent below.

The gear pumps 28*a, b* and *c* are connected by supply lines 42*a, b* and *c*, respectively, to spraying fixture 44*a, b* and *c*. Only the spraying fixture 44*a* is illustrated in detail in FIG. 1, it being understood that the other fixtures 44*b* and *c*, shown schematically in FIG. 1, are identical to fixture 44*a*.

In the presently preferred embodiment, the spraying fixture 44*a* includes three spray guns 46*a–c*. Spray gun 46*a* is connected to supply line 42*a*, a connector line 43 interconnects spray guns 46*a* and 46*b* and a second connector line 45 interconnects spray guns 46*b* and 46*c*. Each spray gun 46*a–c* has an internal passageway (not shown) which recirculates coating material therethrough when such guns 46*a–c* are closed and not discharging coating material. Spray gun 46*c* is connected to a return line 47 which extends back to line 14 to transmit coating material either into the reservoir 16 or to the inlet of primary pump 12.

A valve 50 is connected to the return line 47 downstream from the spray guns 46*a–c*. A pressure sensor, preferably in the form of a pressure switch 54, is connected to the return line 47 between the spray guns 46*a–c* and valve 50. The pressure switch 54 operates an alarm 56 which produces a visual or audible signal.

A programmable controller 58 is connected to each of the spray guns 46*a–c* and to the valve 50. The controller 58 is operative to open and close each of the spray guns 46*a–c* independently of one another, and to open and close the valve 50. As shown schematically in FIG. 1, the controller 58 is also operatively connected to fixtures 44*b, c* and operates them in the same manner as described below.

The spray system 10 illustrated in FIG. 1 operates as follows. Heated coating material such as molten wax from the reservoir 16 is pumped by the primary pump 12 to the inlet 22 of manifold 20. The coating material enters the distribution passageway 24 in the manifold 20 and then flows through the branch lines 26 to each of the gear pumps 28*a–c*. The gear pumps 28*a–c* are effective to discharge a metered quantity of coating material through their outlets 38 and into the supply lines 42*a–c*, respectively, which are connected to the spraying fixtures 44*a–c*.

The controller 58 is operative to open one of the spray guns 46*a–c* of fixture 44*a* to permit the discharge of coating material therefrom, and to simultaneously close the valve 50 to block the flow of coating material therethrough. Depending upon the requirements of a particular application, the spray guns 46*a–c* may be operated sequentially or simultaneously by controller 58, although it is preferable that only one spray gun 46*a–c* be operated at any given time. Coating material entering any one of the spray guns 46*a–c* which has not been opened by the controller 58 is recirculated therethrough into one of the lines 43, 45 or 47. When a spraying operation is completed, the controller 58 closes all of the spray guns 46*a, b, c* and simultaneously opens the valve 50 to permit the flow of coating material through the return line 47 back to the primary pump 12 or reservoir 16.

In a typical spraying operation, the spray guns 46*a–c* are often positioned in locations where they are hidden from the operator's view. In the event one or more of the spray guns 46*a–c* in any of the fixtures 44*a–c* fails to spray the required quantity of coating material because of a clog or other malfunction, provision is made in the spray system 10 herein to notify the operator of such a problem.

For example, assume spray gun 46*a* has been opened by the controller 58 but becomes clogged or otherwise malfunctions so that coating material from the supply line 42*a* cannot flow at the desired rate through the spray gun 46*a*. Initially, the gear pump 28*a* feeding coating material into the supply line 42*a* continues to operate at the same rate, and some or all of the coating material is diverted through spray gun 46*a* into line 43, and then through guns 46*b* and *c* into return line 47, because of the clogged condition of spray gun 46*a*. With valve 50 in a closed position, a back pressure is therefore created within the return line 47. This back pressure is sensed by the pressure switch 54 which is effective at a predetermined pressure level to activate alarm 56 and notify the operator that corrective measures are required.

In the event of a malfunction of the pressure switch 54 or alarm 56, the relief valve 40 associated with each gear pump 28*a* is effective to recirculate coating material from the outlet line 38 back to the branch line 26, i.e., from the output side to the input side of gear pump 28*a*. The relief valve 40 is set to open at a higher pressure than that required to activate the pressure switch 54 so that the alarm 56 is activated before the relief valve 40 is opened, assuming the pressure switch 54 is operating correctly.

Figure 2:
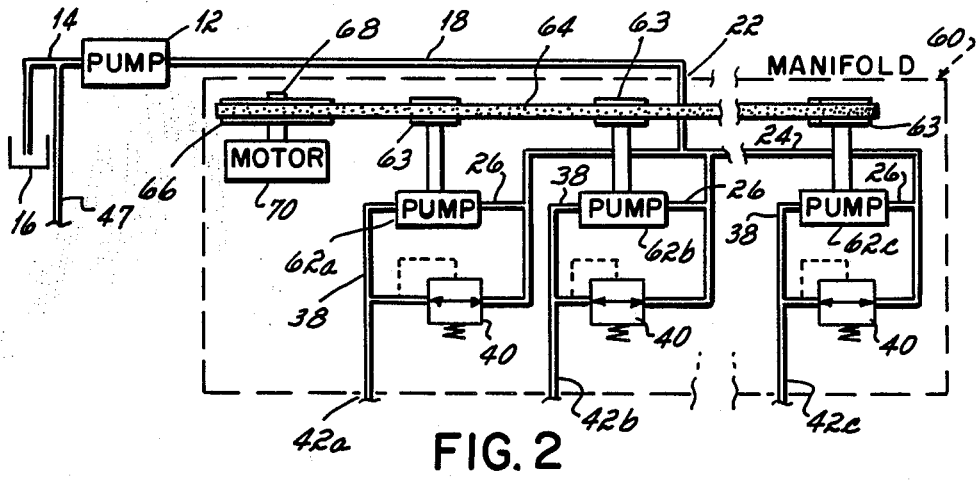
FIG. 2 is an alternative embodiment of the system herein which includes a manifold employing pulley driven pumps for supplying coating material to the fixtures.

Referring now to FIG. 2, an alternative embodiment of a manifold 60 for spray system 10 is illustrated. In this embodiment, the manifold 60 has the same inlet 22, distribution passageway 24 and branch lines 26 as manifold 20, but instead of gear pumps 28*a–c*, the manifold 60 employs pulley-driven pumps 62*a–c*. The pulley-driven pumps 62*a–c* are drivingly connected by a belt 64 to a drive pulley 66 carried on the output shaft 68 of a motor 70. The motor 70 is effective to drive each of the pulley pumps 62 to supply coating material to the fixtures 44*a–c* in the identical manner described above. In this embodiment, it is contemplated that the diameter of the pulley 63 of each pulley pumps 62*a–c* could vary from one pulley pump 62 to another so that a different flow rate could be obtained from different pulley pumps 62*a–c* using a common drive belt 64 and drive pulley 66. This arrangement is advantageous in some applications wherein it is desirable to spray different quantities of coating materials from different spraying fixtures 44*a–c*.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

I claim:

1. Apparatus for applying a coating material to a surface, comprising:

supply means for transmitting coating material;

at least one spray device connected to said supply means, said spray device being movable to an open position to discharge coating material transmitted through said supply means onto a surface;

a valve connected to said supply means, said valve being movable to a closed position wherein coating material is prevented from flowing therethrough;

a controller connected to said spray device and to said valve, said controller being effective to move said spray device to said open position and to simultaneously move said valve to said closed position;

alarm means for producing an alarm;

sensor means for sensing the fluid pressure in said supply means at a location upstream from said valve, said sensor means being effective to activate said alarm means to produce an alarm when said fluid pressure within said supply means reaches a predetermined level.

2. The apparatus of claim 1 in which said sensor means comprises a pressure switch connected to said supply means upstream from said valve.

3. Apparatus for applying a coating material to a surface, comprising:

a primary pump connected to a source of coating material;

a flow divider having a distribution passageway connected to said primary pump, said flow divider including a number of secondary pumps each having an inlet connected to said distribution passageway for receiving coating material and an outlet for ejecting a metered quantity of coating material;

a number of spraying fixtures each connected to said outlet of one of said secondary pumps to receive coating material, each of said spraying fixtures including at least one spray device movable to an open position to discharge coating material onto a surface, and each of said spraying fixtures including a valve movable to a closed position wherein coating material is prevented from passing therethrough;

a controller connected to each of said spraying fixtures, said controller being effective to move at least one of said spray devices in each said spraying fixtures to said open position and to simultaneously move said valve in each said spraying fixtures to said closed position so that coating material is discharged from said spray devices and prevented from flowing through said valve;

an alarm for producing an alarm signal;

a pressure switch located upstream relative to said valve in each of said fixtures, said pressure switch being effective to sense the fluid pressure within said fixture and to activate said alarm to produce an alarm signal in the event said fluid pressure within said fixture reaches a predetermined level.

4. The apparatus of claim 3 in which a supply line extends between each of said secondary pumps and one of said fixtures to transmit coating material into said fixtures and a return line extends between each of said fixtures and said primary pump to return coating material to said primary pump, each of said fixtures including connector lines interconnecting said spray devices, one of said connector lines being connected to said supply line and another of said connector lines being connected to said return line, said valve in each said fixture being located in said return line downstream relative to said spray devices.

5. The apparatus of claim 4 in which said pressure switch in each said fixtures is connected to said return line between said valve and said spray devices.

6. The apparatus of claim 3 in which each of said secondary pumps in said flow divider are metering gear pumps drivingly connected to a common shaft, said common shaft being driven by the output of a motor.

7. The apparatus of claim 3 in which each of said secondary pumps in said flow divider are pulley driven pumps, said pulley driven pumps being drivingly connected to a common pulley driven by the output of a motor.

8. Apparatus for applying coating material to a surface, comprising:

a line for transmitting coating material;

at least one spraying device connected to said line;

a valve connected to said line;

means for opening said spraying device to permit the discharge of coating material therefrom onto a surface, and for simultaneously closing said valve to prevent the of coating material therethrough;

means for sensing the fluid pressure within said line at a location upstream relative to said valve and for activating an alarm in the event said fluid pressure reaches a predetermined level.

9. The method of applying a coating material to a surface, comprising:

transmitting coating material through a line which is connected to at least one spray device and to a valve;

simultaneously opening said spray device and closing said valve so that coating material is discharged from said spray device onto a surface and is prevented from flowing through said valve;

sensing the fluid pressure within said line at a location upstream relative to said valve;

activating an alarm in the event said fluid pressure within said line reaches a predetermined level.

* * * * *